US010954772B2

(12) United States Patent
Fang et al.

(10) Patent No.: US 10,954,772 B2
(45) Date of Patent: Mar. 23, 2021

(54) AUTOMATED OPTIMIZATION OF DOWNHOLE TOOLS DURING UNDERREAMING WHILE DRILLING OPERATIONS

(71) Applicants: Lei Fang, Katy, TX (US); Sergiy Grymalyuk, Lachendorf (DE); Michell Schimanski, Edemissen (DE)

(72) Inventors: Lei Fang, Katy, TX (US); Sergiy Grymalyuk, Lachendorf (DE); Michell Schimanski, Edemissen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 348 days.

(21) Appl. No.: 15/704,238

(22) Filed: Sep. 14, 2017

(65) Prior Publication Data

US 2019/0078428 A1 Mar. 14, 2019

(51) Int. Cl.

| | |
|---|---|
| ***E21B 44/00*** | (2006.01) |
| ***E21B 44/04*** | (2006.01) |
| ***E21B 44/06*** | (2006.01) |
| ***E21B 47/12*** | (2012.01) |

(Continued)

(52) U.S. Cl.

CPC ..... *E21B 44/04* (2013.01); *E21B 4/04* (2013.01); *E21B 10/26* (2013.01); *E21B 44/005* (2013.01); *E21B 44/06* (2013.01); *E21B 47/12* (2013.01)

(58) Field of Classification Search

CPC ..... E21B 44/005; E21B 7/28; E21B 10/32

See application file for complete search history.

(56) References Cited

U.S. PATENT DOCUMENTS

| | | | |
|---|---|---|---|
| 5,474,142 | A | 12/1995 | Bowden |
| 6,179,066 | B1 | 1/2001 | Nasr et al. |
| 7,172,037 | B2 | 2/2007 | Dashevskiy et al. |

(Continued)

FOREIGN PATENT DOCUMENTS

| | | | |
|---|---|---|---|
| WO | 2014142783 | A1 | 9/2014 |
| WO | 2016182546 | A1 | 11/2016 |

OTHER PUBLICATIONS

Jain, et al. "Self-adjusting PDC Bits Could Enable Autonomous Drilling Systems";[Retrieved from the internet Apr. 27, 2017; URL: http://www.epmag.com/self-adjusting-pdc-bits-could-enable-autonomous-drilling-systems-850286] Published Jun. 1, 2016 (4 pages).

(Continued)

*Primary Examiner* — Shane Bomar

(74) *Attorney, Agent, or Firm* — Cantor Colburn LLP

(57) ABSTRACT

Systems and methods for adjusting a drilling operation, the methods and systems include obtaining, at a control system, a first drilling characteristic associated with a first drilling operation device that is part of a drilling system on a drill string; obtaining, at the control system, a second drilling characteristic associated with a second drilling operation device located apart from the first drilling operation device along the drill string; and controlling, with the control system, at least one adjustable element of the first drilling operation device in response to at least one of the obtained first drilling characteristic and the second drilling characteristic, wherein adjustment of the at least one adjustable element causes a change in at least one of the first drilling characteristic and the second drilling characteristic.

20 Claims, 7 Drawing Sheets

(51) Int. Cl.
*E21B 10/26* (2006.01)
*E21B 4/04* (2006.01)

(56) References Cited

U.S. PATENT DOCUMENTS

| | | | | |
|---|---|---|---|---|
| 8,011,452 | B2 * | 9/2011 | Downton | E21B 7/062 175/76 |
| 8,833,487 | B2 | 9/2014 | Krueger et al. | |
| 9,004,195 | B2 | 4/2015 | Regener et al. | |
| 9,043,154 | B2 | 5/2015 | Luxey | |
| 9,103,195 | B2 | 8/2015 | Gawski et al. | |
| 9,249,654 | B2 | 2/2016 | Strachan et al. | |
| 9,255,450 | B2 | 2/2016 | Jain et al. | |
| 9,297,205 | B2 | 3/2016 | Benson et al. | |
| 9,518,450 | B2 | 12/2016 | Servaes et al. | |
| 2005/0284659 | A1 * | 12/2005 | Hall | E21B 44/00 175/27 |
| 2006/0021797 | A1 * | 2/2006 | Krueger | E21B 7/062 175/61 |
| 2007/0056772 | A1 * | 3/2007 | Koederitz | E21B 7/28 175/53 |
| 2010/0212964 | A1 * | 8/2010 | Beuershausen | E21B 10/62 175/57 |
| 2010/0282511 | A1 | 11/2010 | Maranuk et al. | |
| 2010/0303570 | A1 * | 12/2010 | Denoix | E21B 10/62 408/227 |
| 2013/0008647 | A1 * | 1/2013 | Dirksen | E21B 21/103 166/250.01 |
| 2013/0098682 | A1 | 4/2013 | Desai | |
| 2014/0182934 | A1 | 6/2014 | Samuel | |
| 2014/0326449 | A1 | 11/2014 | Samuel et al. | |
| 2015/0053484 | A1 * | 2/2015 | Meister | E21B 7/04 175/26 |
| 2015/0247396 | A1 | 3/2015 | Tunc et al. | |
| 2015/0240617 | A1 | 8/2015 | Pelletier et al. | |
| 2016/0053551 | A1 | 2/2016 | Jain et al. | |
| 2017/0002641 | A1 | 1/2017 | Dykstra et al. | |
| 2017/0175455 | A1 * | 6/2017 | Jain | E21B 10/633 |
| 2019/0353022 | A1 * | 11/2019 | Hepburn | E21B 19/04 |

OTHER PUBLICATIONS

International Search Report, International Application No. PCT/US2018/050810, dated Jan. 9, 2019, Korean Intellectual Property Office; International Search Report 4 pages.

International Written Opinion, International Application No. PCT/US2018/050810, dated Jan. 9, 2019, Korean Intellectual Property Office; International Written Opinion 10 pages.

* cited by examiner

AUTOMATED OPTIMIZATION OF DOWNHOLE TOOLS DURING UNDERREAMING WHILE DRILLING OPERATIONS

BACKGROUND

1. Field of the Invention

The present invention generally relates to downhole operations and optimization of downhole components during drilling operations.

2. Description of the Related Art

Boreholes are drilled deep into the earth for many applications such as carbon dioxide sequestration, geothermal production, and hydrocarbon exploration and production. In all of the applications, the boreholes are drilled such that they pass through or allow access to a material (e.g., a gas or fluid) contained in a formation located below the earth's surface. Different types of tools and instruments may be disposed in the boreholes to perform various tasks and measurements.

When performing downhole operations, such as drilling, various environmental, formation, and/or operational characteristics may impact an efficiency of a drilling operation. The disclosure herein provides improvements to adjusting operation of individual elements of a drilling system.

SUMMARY

Disclosed herein are systems and methods for adjusting a drilling operation, the methods and systems include obtaining, at a control system, a first drilling characteristic associated with a first drilling operation device that is part of a drilling system on a drill string; obtaining, at the control system, a second drilling characteristic associated with a second drilling operation device located apart from the first drilling operation device along the drill string; and controlling, with the control system, at least one adjustable element of the first drilling operation device in response to at least one of the obtained first drilling characteristic and the second drilling characteristic, wherein adjustment of the at least one adjustable element causes a change in at least one of the first drilling characteristic and the second drilling characteristic.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Figure 1:
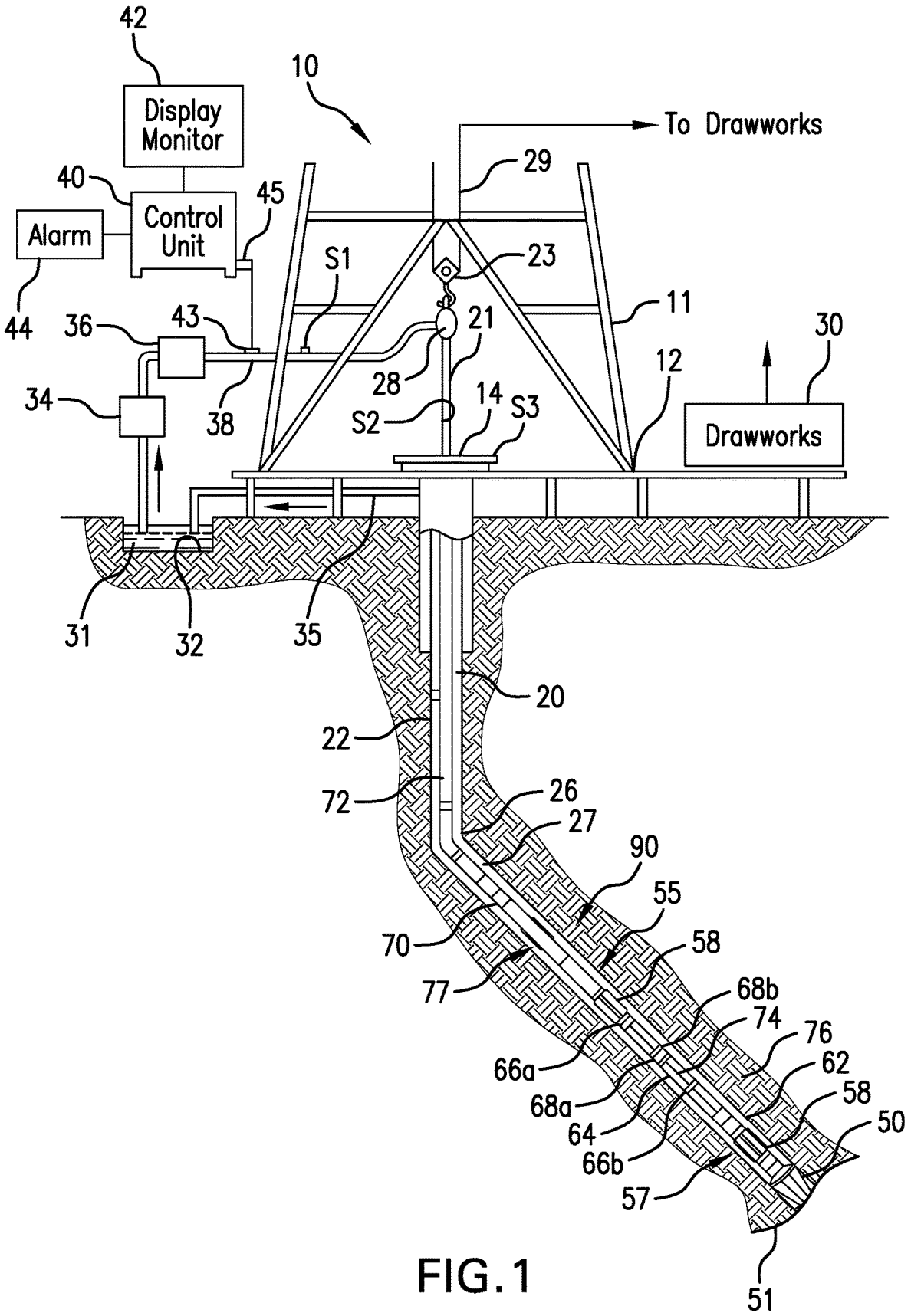
FIG. 1 is an example of a system for performing downhole operations that can employ embodiments of the present disclosure.

FIG. 1 shows a schematic diagram of a system for performing downhole operations. As shown, the system is a drilling system 10 that includes a drill string 20 having a drilling assembly 90, also referred to as a bottomhole assembly (BHA), conveyed in a borehole 26 penetrating an earth formation. The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A disintegrating tool 50, such as a drill bit attached to the end of the BHA 90, disintegrates the geological formations when it is rotated to drill the borehole 26. The drill string 20 is coupled to a drawworks 30 via a kelly joint 21, swivel 28 and line 29 through a pulley 23. During the drilling operations, the drawworks 30 is operated to control the weight on bit, which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes into the drill string 20 via a desurger 36, fluid line 38 and the kelly joint 21. The drilling fluid 31 is discharged at the borehole bottom 51 through an opening in the disintegrating tool 50. The drilling fluid 31 circulates uphole through the annular space 27 between the drill string 20 and the borehole 26 and returns to the mud pit 32 via a return line 35. A sensor S1 in the line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the wellbore 26. The system may further include one or more downhole sensors 70 located on the drill string 20 and/or the BHA 90.

In some applications the disintegrating tool 50 is rotated by only rotating the drill pipe 22. However, in other applications, a drilling motor 55 (mud motor) disposed in the drilling assembly 90 is used to rotate the disintegrating tool 50 and/or to superimpose or supplement the rotation of the drill string 20. In either case, the rate of penetration (ROP) of the disintegrating tool 50 into the borehole 26 for a given formation and a drilling assembly largely depends upon the weight on bit and the drill bit rotational speed. In one aspect of the embodiment of FIG. 1, the mud motor 55 is coupled to the disintegrating tool 50 via a drive shaft (not shown) disposed in a bearing assembly 57. The mud motor 55 rotates the disintegrating tool 50 when the drilling fluid 31 passes through the mud motor 55 under pressure. The bearing assembly 57 supports the radial and axial forces of the disintegrating tool 50, the downthrust of the drilling motor and the reactive upward loading from the applied weight on bit. Stabilizers 58 coupled to the bearing assembly 57 and other suitable locations act as centralizers for the lowermost portion of the mud motor assembly and other such suitable locations.

A surface control unit 40 receives signals from the downhole sensors 70 and devices via a sensor 43 placed in the fluid line 38 as well as from sensors S1, S2, S3, hook load sensors and any other sensors used in the system and processes such signals according to programmed instructions provided to the surface control unit 40. The surface control unit 40 displays desired drilling parameters and other information on a display/monitor 42 for use by an operator at the rig site to control the drilling operations. The surface control unit 40 contains a computer, memory for storing data, computer programs, models and algorithms accessible to a processor in the computer, a recorder, such as tape unit, memory unit, etc. for recording data and other peripherals. The surface control unit 40 also may include simulation models for use by the computer to processes data according to programmed instructions. The control unit responds to user commands entered through a suitable device, such as a keyboard. The control unit 40 is adapted to activate alarms 44 when certain unsafe or undesirable operating conditions occur.

The drilling assembly 90 also contains other sensors and devices or tools for providing a variety of measurements relating to the formation surrounding the borehole and for drilling the wellbore 26 along a desired path. Such devices may include a device for measuring the formation resistivity near and/or in front of the drill bit, a gamma ray device for measuring the formation gamma ray intensity and devices for determining the inclination, azimuth and position of the drill string. A formation resistivity tool 64, made according an embodiment described herein may be coupled at any suitable location, including above a lower kick-off subassembly 62, for estimating or determining the resistivity of the formation near or in front of the disintegrating tool 50 or at other suitable locations. An inclinometer 74 and a gamma ray device 76 may be suitably placed for respectively determining the inclination of the BHA and the formation gamma ray intensity. Any suitable inclinometer and gamma ray device may be utilized. In addition, an azimuth device (not shown), such as a magnetometer or a gyroscopic device, may be utilized to determine the drill string azimuth. Such devices are known in the art and therefore are not described in detail herein. In the above-described exemplary configuration, the mud motor 55 transfers power to the disintegrating tool 50 via a hollow shaft that also enables the drilling fluid to pass from the mud motor 55 to the disintegrating tool 50. In an alternative embodiment of the drill string 20, the mud motor 55 may be coupled below the resistivity measuring device 64 or at any other suitable place.

Still referring to FIG. 1, other logging-while-drilling (LWD) devices (generally denoted herein by numeral 77), such as devices for measuring formation porosity, permeability, density, rock properties, fluid properties, etc. may be placed at suitable locations in the drilling assembly 90 for providing information useful for evaluating the subsurface formations along borehole 26. Such devices may include, but are not limited to, acoustic tools, nuclear tools, nuclear magnetic resonance tools and formation testing and sampling tools.

The above-noted devices transmit data to a downhole telemetry system 72, which in turn transmits the received data uphole to the surface control unit 40. The downhole telemetry system 72 also receives signals and data from the surface control unit 40 and transmits such received signals and data to the appropriate downhole devices. In one aspect, a mud pulse telemetry system may be used to communicate data between the downhole sensors 70 and devices and the surface equipment during drilling operations. A transducer 43 placed in the mud supply line 38 detects the mud pulses responsive to the data transmitted by the downhole telemetry 72. Transducer 43 generates electrical signals in response to the mud pressure variations and transmits such signals via a conductor 45 to the surface control unit 40. In other aspects, any other suitable telemetry system may be used for two-way data communication between the surface and the BHA 90, including but not limited to, an acoustic telemetry system, an electro-magnetic telemetry system, a wireless telemetry system that may utilize repeaters in the drill string or the wellbore and a wired pipe. The wired pipe may be made up by joining drill pipe sections, wherein each pipe section includes a data communication link that runs along the pipe. The data connection between the pipe sections may be made by any suitable method, including but not limited to, hard electrical or optical connections, induction, capacitive or resonant coupling methods. In case a coiled-tubing is used as the drill pipe 22, the data communication link may be run along a side of the coiled-tubing.

The drilling system described thus far relates to those drilling systems that utilize a drill pipe to conveying the drilling assembly 90 into the borehole 26, wherein the weight on bit is controlled from the surface, typically by controlling the operation of the drawworks. However, a large number of the current drilling systems, especially for drilling highly deviated and horizontal wellbores, utilize coiled-tubing for conveying the drilling assembly downhole. In such application a thruster is sometimes deployed in the drill string to provide the desired force on the drill bit. Also, when coiled-tubing is utilized, the tubing is not rotated by a rotary table but instead it is injected into the wellbore by a suitable injector while the downhole motor, such as mud motor 55, rotates the disintegrating tool 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* or and receivers 68*a* or 68*b*. Resistivity can be one formation property that is of interest in making drilling decisions. Those of skill in the art will appreciate that other formation property tools can be employed with or in place of the resistivity tool 64.

Liner drilling can be one configuration or operation used for providing a disintegrating device becomes more and more attractive in the oil and gas industry as it has several advantages compared to conventional drilling. One example of such configuration is shown and described in commonly owned U.S. Pat. No. 9,004,195, entitled "Apparatus and Method for Drilling a Wellbore, Setting a Liner and Cementing the Wellbore During a Single Trip," which is incorporated herein by reference in its entirety. Importantly, despite a relatively low rate of penetration, the time of getting the liner to target is reduced because the liner is run in-hole while drilling the wellbore simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

Although FIG. 1 is shown and described with respect to a drilling operation, those of skill in the art will appreciate that similar configurations, albeit with different components, can be used for performing different downhole operations. For example, wireline, coiled tubing, and/or other configurations can be used as known in the art. Further, production configurations can be employed for extracting and/or injecting materials from/into earth formations. Thus, the present disclosure is not to be limited to drilling operations but can be employed for any appropriate or desired downhole operation(s).

Figure 2:
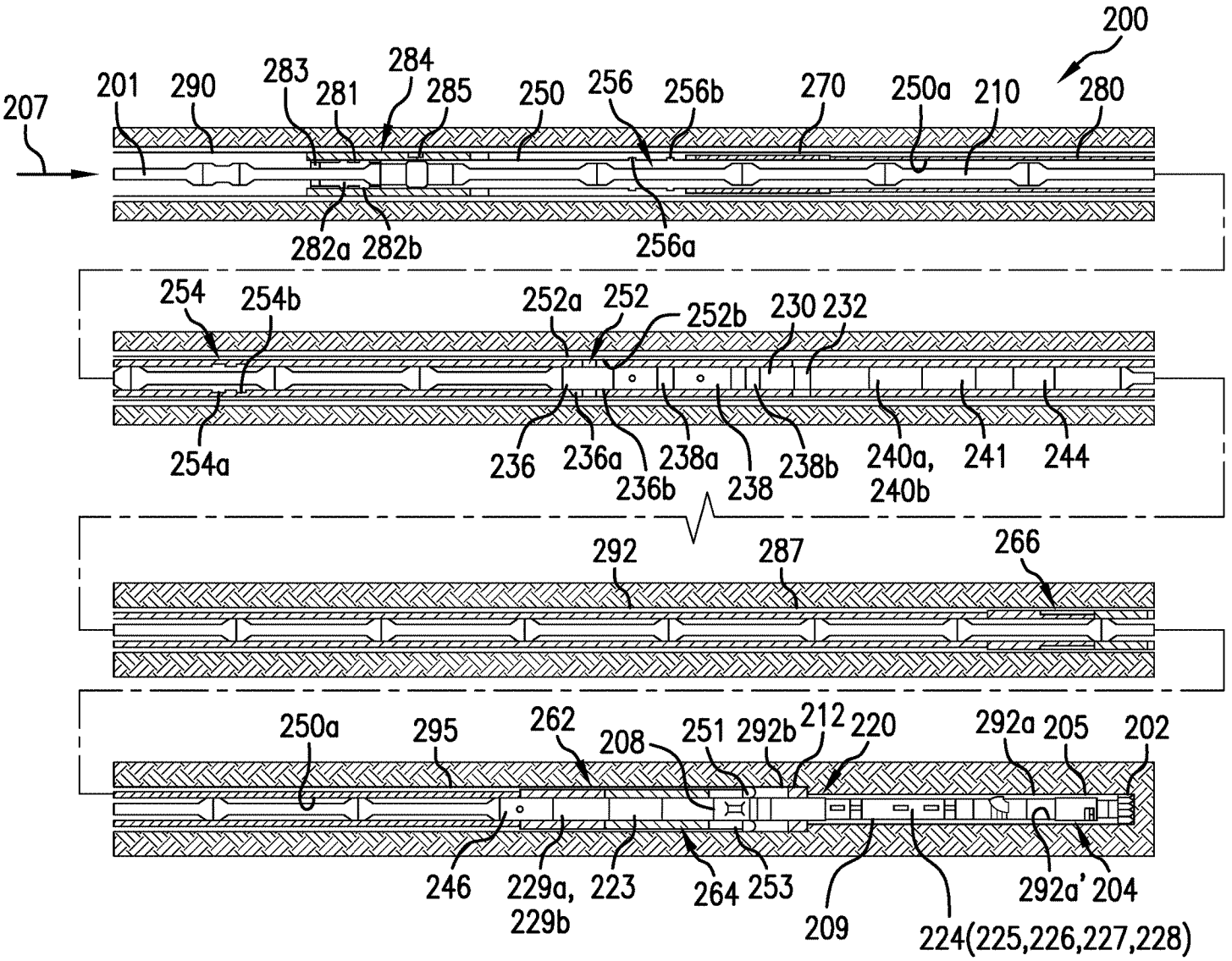
FIG. 2 is a line diagram of an example drill string that includes an inner string and an outer string, wherein the inner string is connected to a first location of the outer string to drill a hole of a first size that can employ embodiments of the present disclosure.

Turning now to FIG. 2, a schematic line diagram of an example system 200 that includes an inner structure 210 disposed in an outer structure 250 is shown. In this embodiment, the inner structure 210 is an inner string, including a bottom hole assembly, as described below. Further, as illustrated, the outer structure 250 is a casing or outer string. The inner structure 210 includes various tools that are moveable within and relative to the outer structure 250. As described herein, various of the tools of the inner structure 210 can act upon and/or with portions of the outer structure 250 to perform certain downhole operations. Further, various of the tools of the inner structure 210 can extend beyond the outer structure 250 to perform other downhole operations, such as drilling.

In this embodiment, the inner structure 210 is adapted to pass through the outer structure 250 and connect to the inside 250*a* of the outer structure 250 at a number of spaced apart locations (also referred to herein as the "landings" or "landing locations"). The shown embodiment of the outer structure 250 includes three landings, namely a lower landing 252, a middle landing 254 and an upper landing 256. The inner structure 210 includes a drilling assembly or disintegrating assembly 220 (also referred to as the "bottomhole assembly") connected to a bottom end of a tubular member 201, such as a string of jointed pipes or a coiled tubing. The drilling assembly 220 includes a first disintegrating device 202 (also referred to herein as a "pilot bit") at its bottom end for drilling a borehole of a first size 292*a* (also referred to herein as a "pilot hole"). The drilling assembly 220 further includes a steering device 204 that in some embodiments may include a number of force application members 205 configured to extend from the drilling assembly 220 to apply force on a wall 292*a*' of the pilot hole 292*a* drilled by the pilot bit 202 to steer the pilot bit 202 along a selected direction, such as to drill a deviated pilot hole. The drilling assembly 220 may also include a drilling motor 208 (also referred to as a "mud motor") 208 configured to rotate the pilot bit 202 when a fluid 207 under pressure is supplied to the inner structure 210.

In the configuration of FIG. 2, the drilling assembly 220 is also shown to include an under reamer 212 that can be extended from and retracted toward a body of the drilling assembly 220, as desired, to enlarge the pilot hole 292*a* to form a wellbore 292*b*, to at least the size of the outer string. In various embodiments, for example as shown, the drilling assembly 220 includes a number of sensors (collectively designated by numeral 209) for providing signals relating to a number of downhole parameters, including, but not limited to, various properties or characteristics of a formation 295 and parameters relating to the operation of the system 200. The drilling assembly 220 also includes a control circuit (also referred to as a "controller") 224 that may include circuits 225 to condition the signals from the various sensors 209, a processor 226, such as a microprocessor, a data storage device 227, such as a solid-state memory, and programs 228 accessible to the processor 226 for executing instructions contained in the programs 228. The controller 224 communicates with a surface controller (not shown) via a suitable telemetry device 229*a* that provides two-way communication between the inner structure 210 and the surface controller. The telemetry unit 229*a* may utilize any suitable data communication technique, including, but not limited to, mud pulse telemetry, acoustic telemetry, electromagnetic telemetry, and wired pipe. A power generation unit 229*b* in the inner structure 210 provides electrical power to the various components in the inner structure 210, including the sensors 209 and other components in the drilling assembly 220. The drilling assembly 220 also may include a second power generation device 223 capable of providing electrical power independent from the presence of the power generated using the drilling fluid 207 (e.g., third power generation device 240*b* described below). In some embodiments, the controller 224 may be part of a control system that includes elements located downhole and/or at the surface, with possibly multiple controllers, control units, and/or control elements located in various locations throughout the downhole structures and/or at the surface.

In various embodiments, such as that shown, the inner structure 210 may further include a sealing device 230 (also referred to as a "seal sub") that may include a sealing element 232, such as an expandable and retractable packer, configured to provide a fluid seal between the inner structure 210 and the outer structure 250 when the sealing element 232 is activated to be in an expanded state. Additionally, the inner structure 210 may include a liner drive sub 236 that includes attachment elements 236*a*, 236*b* (e.g., latching elements) that may be removably connected to any of the landing locations in the outer structure 250. The inner structure 210 may further include a hanger activation device or sub 238 having seal members 238*a*, 238*b* configured to activate a rotatable hanger 270 in the outer structure 250. The inner structure 210 may include a third power generation device 240*b*, such as a turbine-driven device, operated by the fluid 207 flowing through the inner string 210 configured to generate electric power, and a second two-way telemetry device 240*a* utilizing any suitable communication technique, including, but not limited to, mud pulse, acoustic, electromagnetic and wired pipe telemetry. The inner structure 210 may further include a fourth power generation device 241, independent from the presence of a power generation source using drilling fluid 207, such as batteries. The inner structure 210 may further include pup joints 244 and a burst sub 246.

Still referring to FIG. 2, the outer structure 250 includes a liner 280 that may house or contain a second disintegrating device 251 (e.g., also referred to herein as a "reamer bit") at its lower end thereof. The reamer bit 251 is configured to enlarge a leftover portion of hole 292*a* made by the pilot bit 202. In aspects, attaching the inner string at the lower landing 252 enables the inner structure 210 to drill the pilot hole 292*a* and the under reamer 212 to enlarge it to the borehole of size 292 that is at least as large as the outer structure 250. Attaching the inner structure 210 at the middle landing 254 enables the reamer bit 251 to enlarge the section of the hole 292*a* not enlarged by the under reamer 212 (also referred to herein as the "leftover hole" or the "remaining pilot hole"). Attaching the inner structure 210 at the upper landing 256, enables cementing an annulus 287 between the liner 280 and the formation 295 without pulling the inner structure 210 to the surface, i.e., in a single trip of the system 200 downhole. The lower landing 252 includes a female spline 252*a* and a collet groove 252*b* for attaching to the attachment elements 236*a* and 236*b* of the liner drive sub 236. Similarly, the middle landing 254 includes a female spline 254*a* and a collet groove 254*b* and the upper landing 256 includes a female spline 256*a* and a collet groove 256*b*. Any other suitable attaching and/or latching mechanisms for connecting the inner structure 210 to the outer structure 250 may be utilized for the purpose of this disclosure.

The outer structure 250 may further include a flow control device 262, such as a backflow prevention assembly or device, placed on the inside 250*a* of the outer structure 250 proximate to its lower end 253. In FIG. 2, the flow control device 262 is in a deactivated or open position. In such a position, the flow control device 262 allows fluid communication between the wellbore 292 and the inside 250*a* of the outer structure 250. In some embodiments, the flow control device 262 can be activated (i.e., closed) when the pilot bit 202 is retrieved inside the outer structure 250 to prevent fluid communication from the wellbore 292 to the inside 250*a* of the outer structure 250. The flow control device 262 is deactivated (i.e., opened) when the pilot bit 202 is extended outside the outer structure 250. In one aspect, the force application members 205 or another suitable device may be configured to activate the flow control device 262.

A reverse flow control device 266, such as a reverse flapper or other backflow prevention structure, also may be provided to prevent fluid communication from the inside of the outer structure 250 to locations below the reverse flow control device 266. The outer structure 250 also includes a hanger 270 that may be activated by the hanger activation sub 238 to anchor the outer structure 250 to the host casing 290. The host casing 290 is deployed in the wellbore 292 prior to drilling the wellbore 292 with the system 200. In one aspect, the outer structure 250 includes a sealing device 285 to provide a seal between the outer structure 250 and the host casing 290. The outer structure 250 further includes a receptacle 284 at its upper end that may include a protection sleeve 281 having a female spline 282*a* and a collet groove 282*b*. A debris barrier 283 may also be provided to prevent cuttings made by the pilot bit 202, the under reamer 212, and/or the reamer bit 251 from entering the space or annulus between the inner structure 210 and the outer structure 250.

To drill the wellbore 292, the inner structure 210 is placed inside the outer structure 250 and attached to the outer structure 250 at the lower landing 252 by activating the attachment elements 236*a*, 236*b* of the liner drive sub 236 as shown. This liner drive sub 136, when activated, connects the attachment element 236*a* to the female splines 252*a* and the attachment element 236*b* to the collet groove 252*b* in the lower landing 252. In this configuration, the pilot bit 202 and the under reamer 212 extend past the reamer bit 251. In operation, the drilling fluid 207 powers the drilling motor 208 that rotates the pilot bit 202 to cause it to drill the pilot hole 292*a* while the under reamer 212 enlarges the pilot hole 292*a* to the diameter of the wellbore 292. The pilot bit 202 and the under reamer 212 may also be rotated by rotating the drill system 200, in addition to rotating them by the motor 208.

In general, there are three different configurations and/or operations that are carried out with the system 200: drilling, reaming and cementing. In drilling a position the Bottom Hole Assembly (BHA) sticks out completely of the liner for enabling the full measuring and steering capability (e.g., as shown in FIG. 2). In a reaming position, only the first disintegrating device (e.g., pilot bit 202) is outside the liner to reduce the risk of stuck pipe or drill string in case of well collapse and the remainder of the BHA is housed within the outer structure 250. In a cementing position the BHA is configured inside the outer structure 250 a certain distance from the second disintegrating device (e.g., reamer bit 251) to ensure a proper shoe track.

When performing downhole operations, using systems such as that shown and described above in FIGS. 1-2, it is advantageous to monitor what is occurring downhole. Some such solutions include wired pipe (WP) where monitoring is performed using one or more sensors and/or devices and collected data is transmitted via special drill pipes like a "long cable." Another solution has be employed communication via mud pulse telemetry, where the bore fluid is used as a communication channel. In such embodiments, pressure pulses are generated down hole (encoded), and a pressure transducer converts the pressure pulses into electrical signals (encoded). Mud pulse telemetry (MPT) is in comparison with wired pipe very slow (e.g., by a factor of one thousand). One specific piece of information is location. This is particularly true when a downhole operation is desired to be performed at a very specific point along a wellbore, such as, but not limited to, packer deployment, reaming, underreaming, and/or extending stablizers, anchors, or hangers, etc.

For reaming while drilling applications, such as using a system as shown in FIG. 1 or FIG. 2, or variations thereon, proper distribution of downhole weight and torque between different disintegrating devices (e.g., drill bit and reamer) may be a critical factor and consideration to achieve high drilling efficiency and prevent downhole tool failures. While drilling through a formation with varying formation properties, e.g., mechanical strength, a first and second disintegrating device can be located within and operating on different types of formations at the same time. Such disparate drilling operation can present challenging drilling environments. If a first disintegrating device (e.g., drill bit) is in a soft formation while a second disintegrating device (e.g., reamer) is in a hard formation, the first disintegrating device can out-drill the second disintegrating device and expose the second disintegrating device to potentially high risks of tool failure with excessive weight and torque on the second disintegrating device. If a first disintegrating device is drilling through a hard formation while the second disintegrating device is drilling through a soft formation, drilling efficiency can be compromised. Without an ability to adjust drilling characteristics of disintegrating devices in real-time, it is difficult to optimize the weight and torque distribution consistently and timely to achieve a preferred drilling operation.

A provided herein, embodiments of the present disclosure are directed to automatic adjustment of drilling characteristics (e.g., drilling aggressiveness, weight distribution, torque distribution, tool and/or device balance, etc.). In accordance with various embodiments, disintegrating devices of the present disclosure are capable of automatically adjusting aggressiveness downhole and to automatically optimize the weight and torque distribution between the disintegrating devices through real-time closed loop communications. In a non-limiting example of a system of the present disclosure, weight and torque measurements are monitored at each of the first and second disintegrating devices (or at each of a plurality of disintegrating devices) continuously and in real-time. The real-time monitoring enables real-time decision making process that are performed downhole autonomously through a closed loop communication to self-adjust the aggressiveness of either the first or the second disintegrating device to achieve optimal distribution of weight, torque, etc., regardless of formation characteristics of a formation being drilled.

For example, in some embodiments, a first disintegrating device and a disintegrating device will each have embedded sensors to measure weight-on-device (e.g., weight-on-bit, weight-on-reamer, etc.) and torque-at-device. Further, each disintegrating device is arranged to have the ability to adjust aggressiveness downhole and to be able to communication with each other. The weight-on-bit and torque-at-device can be continuously measured and monitored, and if the distribution between the two is not optimal or within a predetermined range of operation, real-time decision is made downhole autonomously through a closed loop communication to self-adjust the aggressiveness of either the first or the second disintegrating device to achieve a desired distribution, regardless of the formation being drilled.

Each of the disintegrating devices is arranged and configured to self-adjust aggressiveness based on input received at each of the disintegrating devices of the system. A process is implemented to evaluate whether or not adjustment is needed to optimize the weight/torque distribution and trigger aggressiveness adjustment in bit and/or reamer. In accordance with some embodiments, a fully automated system is provided with the ability to measure, evaluate, and adjust a drilling operation using two or more disintegrating devices.

Figure 3A:
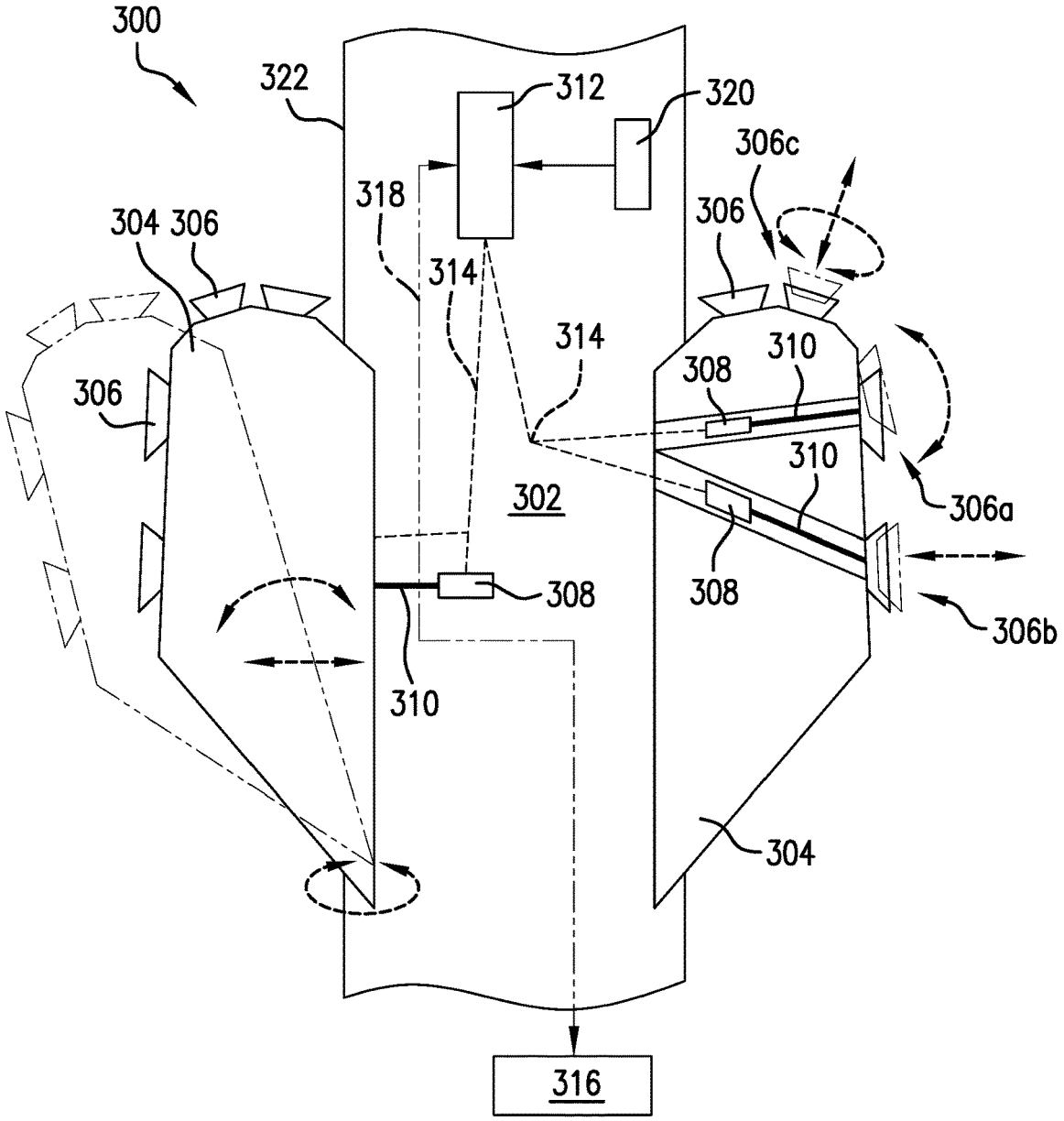
FIG. 3A is a schematic illustration of a drilling operation device arranged in accordance with an embodiment of the present disclosure.
Figure 3B:
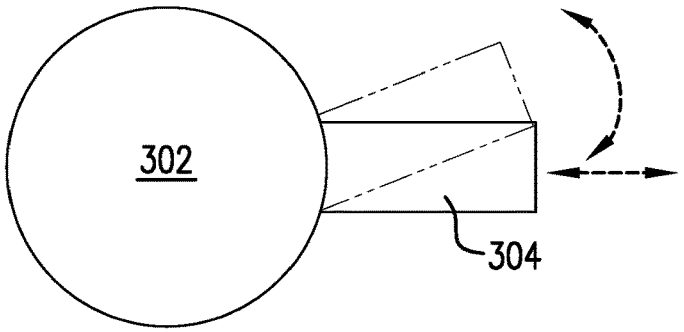
FIG. 3B is a top down illustration of the drilling operation device of FIG. 3A.

Turning now to FIGS. 3A-3B, schematic illustrations of a portion of a drilling operation device 300 in accordance with an embodiment of the present disclosure is shown. FIG. 3A is a side or elevation view illustration of the drilling operation device 300. FIG. 3B is a top down or plan view illustration of the drilling operation device 300.

The drilling operation device 300 is a first disintegrating device that is operably connected to a drill string, as will be appreciated by those skill in the art. The drilling operation device 300 includes a tool body 302 with disintegrating device blades 304 extending therefrom. The drilling operation device 300 may be reamer or other type of disintegrating device arranged on as part of a drilling tool (e.g., part of a BHA, etc.). Each disintegrating device blade 304 includes one or more cutting elements 306 (e.g., cutters). The disintegrating device blades 304 and/or the cutting elements 306 may be adjustable, and are hereinafter collectively referred to as "adjustable elements."

The cutting elements 306 are adjustable and/or movable relative to the tool body 302 and/or the disintegrating device blade 304 and are operably controlled by a drive mechanism 308. The drive mechanism 308 can be a motor, electrical drive unit, pressure arrangement to enable fluid pressure control, etc. The disintegrating device blades 304 are adjustable and/or movable relative to the tool body 302 and are operably controlled by a drive mechanism 308 (which may be the same or different from that of the cutting elements 306). Adjustment or movement of the adjustable elements may include tilting (e.g., changing an angle), lateral or axial movement (e.g., changing an extension), rotation about an axis of the adjustable element, etc. As illustratively shown, each cutting element 306 and disintegrating device blade 304 is operably connected to a dedicated drive mechanism 308 (i.e., one drive mechanism 308 for each adjustable element). In other embodiments, a single drive mechanism may be operably connected to multiple adjustable elements, and thus the present illustration is not to be limiting. As shown, the drive mechanism 308 is operably connected to the respective adjustable element by a control element 310. The control element 310 can be a mechanical, hydraulic, electric, or other type of connection that enables the drive mechanism 308 to control a position and/or orientation (e.g., movement) of the adjustable element.

The drive mechanisms 308 are operably connected and/or controlled by a control system, which can include one or more controllers, control units, and/or control elements. For example, as shown, the control system of FIG. 3 includes a first controller 312. The first controller 312 is associated with the drilling operation device 300 and the adjustable elements thereof. For example, the first controller 312 can be associated with one or more disintegrating blades 304 and/or one or more cutting elements 306 of the disintegrating device blades 304 of the drilling operation device 300. The first controller 312 is in communication with the drive mechanisms 308 through control connections 314. The control connections 314 may be wired or wireless and/or may be arranged as an alternative control scheme (e.g., hydraulic). The first controller 312 includes various electrical and/or electronic components necessary to perform the operations described herein. For example, the first controller 312 can include a processor, memory, and communication elements, as will be appreciated by those of skill in the art. In some embodiments, the first controller 312 is arranged to be in communication with surface elements (e.g., surface control unit 40 shown in FIG. 1).

In the control system shown in FIG. 3, the first controller 312 is also in communication with a second controller 316 that is part of the control system of the present embodiment. The second controller 316 is arranged similar to the first controller 312 as shown in FIG. 3 but with respect to a second disintegrating device or other downhole component located at a different position away from the drilling operation device 300 (e.g., the second disintegrating device may be a drill bit located at a bottom end of a drill string). The first controller 312 and the second controller 316 are in communication through a control connection 318. The control connection 318 may be a connection to enable conveyance and/or transmission of data between the first and second controllers 312, 316. In some non-limiting embodiments, the first and second controller 312, 316 may form a closed-loop control system for performing embodiments in accordance with the present disclosure and as described herein. The closed-loop nature of the system can be provided such that substantially instantaneous response to various conditions and/or events can be achieved.

As shown schematically in FIGS. 3A-3B, various of the cutting element 306 and disintegrating device blades 304 (adjustable elements) are shown illustrating different movements and/or adjustments that are possible in accordance with embodiments of the present disclosure. For example, a first cutting element 306*a* is shown in two positions, with relative rotational adjustment illustrated. A second cutting element 306*b* is shown in two positions with relative extension/retraction. A third cutting element 306*c* is shown illustrating two types of movement, e.g., extension and rotation. The extensions, rotations, pivoting, etc. are relative to the disintegrating device blade 304 of which the cutting elements 306 are a part. The cutting elements 306*a*, 306*b*, 306*c* are shown in first positions in a solid outline and second positions in dashed outlines. Also shown schematically in FIGS. 3A-3B, the disintegrating device blades 304 are also adjustable.

The first controller 312 can control a respective drive mechanism 308 of the first cutting element 306*a* to move or adjust the position of the first cutting element 306*a* from the respective first position to the second position. In this illustration, the transition from the first position to the second position is a change in angle of the first cutting element 306*a* relative to the disintegrating device blade 304 to which it is mounted or attached. The change in angle may be with respect to a cutting angle and/or an angle relative to a surface of the disintegrating device blade 304. Similarly, the first controller 312 can control a respective drive mechanism 308 of the second cutting element 306*b* to move or adjust the position of the second cutting element 306*b* from the respective first position to the second position. In this illustration, the transition from the first position to the second position of the second cutting element 306*b* is a change in extension of the second cutting element 306*b* relative to the disintegrating device blade 304. Similar adjustments are shown with respect to the third cutting element 306*c* and the disintegrating device blade 304.

The adjustment of the various adjustable elements can be used to achieve a desired depth and/or angle of cut. That is, the controller 312 is arranged to achieved a geometric adjustment with respect to the drilling operation device 300 and thus change one or more disintegrating device characteristics.

In some embodiments, the control of the drive mechanisms 308 can be simultaneous or may be individual depending on the arrangement of the system and a desired change in disintegrating device characteristics. The adjustment of the adjustable elements may be in response to information received at the first controller 312 from the second controller 316. Further, the adjustment is based, in part, on sensed data. For example, as shown in FIG. 3, the drilling operation device 300 includes a sensor 320. The sensor 320 is arranged to detect and monitor drilling characteristics and/or disintegrating device characteristics associated with the related disintegrating device and/or drilling operation device 300. The second controller 316 may be in communication with associated sensor(s) to detect drilling characteristics and/or disintegrating device characteristics related to the second disintegrating device.

Although shown in FIG. 3 as a drilling operation device 300 arranged as a disintegrating device (with blades and cutters) those of skill in the art will appreciate that other configurations of the downhole may implement embodiments of the present disclosure without departing from the scope of the present disclosure. For example, the drilling operation device 300 can be arranged as a reamer, a drill bit, a stabilizer tool, or other downhole drilling tool.

The controllers 312, 316 shown in FIG. 3 are arranged to respond to downhole environments and/or events, including, but not limited to, different formations that are being drilled or otherwise worked upon. The controllers 312, 316 and/or another controller of a system of the present disclosure, can be programmed to select specific elements within any of the connected downhole tools (e.g., what to adjust) and perform an adjustment operation (e.g., when to adjust). The drilling operation device 300 is part of a downhole string 322 that is operated to perform a drilling or disintegrating operation.

The downhole string 322 can include multiple drilling operation devices located at different positions that are each arranged to perform a function during a drilling operation. For example, the downhole string 322 can include a drill bit, a lower reamer, an upper reamer, and a stabilizer device (each a "drilling operation device"). Each of the respective drilling operation device can include an associated component of the control system (e.g., similar to controller 312 shown in FIG. 3) or each device may be operably connected to a single controller/control unit. Further, each drilling operation device can include one or more respective sensors arranged to perform monitoring at each drilling operation device. The multiple controllers of the control system (each associated with a respective drilling operation device) are arranged to form a closed loop system. The closed loop system is arranged to respond to operating (downhole) environments, conditions, and/or considerations.

Turning now to FIGS. 4-8, various different example scenarios of operation of embodiments of the present disclosure are schematically shown. In each illustration, a drill string is arranged with two or more drilling operation devices, such as drill bits, reamers, and/or stabilizers.

Figure 4:
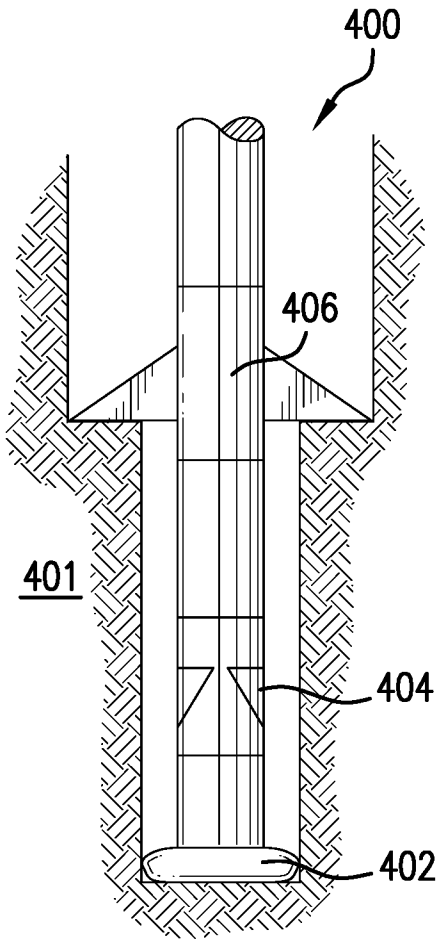
FIG. 4 is a schematic illustration of a first example scenario of operation of drilling string arranged in accordance with an embodiment of the present disclosure.

As shown in FIG. 4, a first example scenario is shown. In FIG. 4, a drill string 400 within a formation 401 is shown having three drilling operation devices 402, 404, 406. In this particular embodiment each of the drilling operation devices 402, 404, 406 is a disintegrating device. The drilling operation devices 402, 404, 406 are arranged at an end of the drill string 400. The drilling operation devices 402, 404, 406 are each arranged with a controller configured therein, with each controller part of a control system of the embodiment shown in FIG. 4, for example, as shown and described above with respect to FIG. 3. Each of the controllers of each drilling operation device 402, 404, 406 is in communication with the other controllers to form a closed loop system. Further, each drilling operation device 402, 404, 406 includes one or more sensors arranged to monitor one or more device characteristics (e.g., torque, weight-on-device, etc.).

In the first example scenario shown in FIG. 4, the first drilling operation device 402 is located at a bottom of a borehole in the formation 401 is operated to disintegrate the material of the formation 401 that is proximate the first drilling operation device 402. The second drilling operation device 404 is deactivated, and the third drilling operation device 406 is activated (and shown as formatting a borehole with a larger diameter than that of the first drilling operation device 402). In this example scenario the first and third drilling operation devices 402, 406 may be subject to different conditions, environments, and/or material characteristics of the formation 401. As such, an optimal drilling operation may not be achieved by a single operating state. To optimize a drilling operation, the control system of the drill string 400 (within the drilling operation device 402, 404, 406) can control the respective drilling operation devices 402, 404, 406 (or portions thereof, e.g., cutting elements/cutters, stabilizer elements, etc., or other adjustable elements). By adjusting characteristics of the individual drilling operation devices 402, 404, 406, an optimal drilling may be achieved. For example, due to an axial distance between the first drilling operation device 402 and the third drilling operation device 406 may be cutting into different strength formation materials (e.g., hardness, etc.) which may affect a drilling efficiency due to torque, weight-on-device, etc. By adjusting adjustable elements of the respective drilling operation devices, the drilling characteristics (e.g., torque, weight-on-device, etc.) can be controlled to achieve an optimal or desired drilling efficiency.

Figure 5:
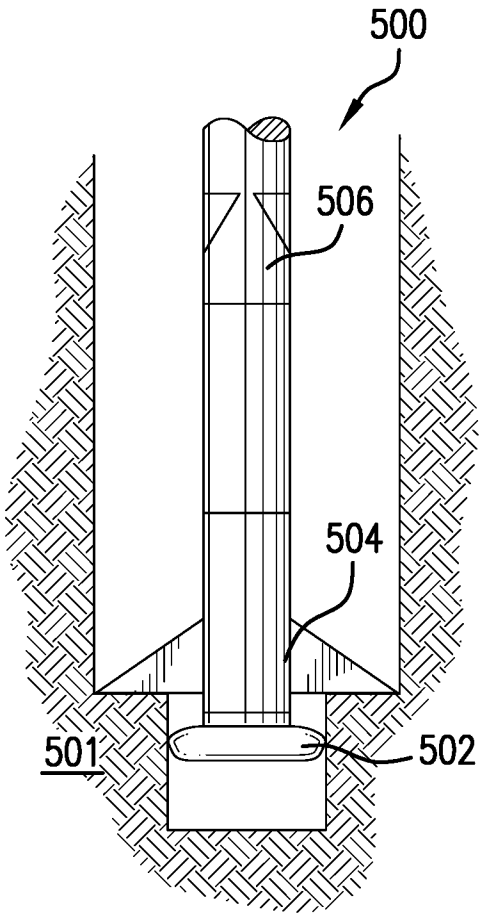
FIG. 5 is a schematic illustration of a second example scenario of operation of drilling string arranged in accordance with an embodiment of the present disclosure.

Turning now to FIG. 5, a second example scenario is shown. In FIG. 5, a drill string 500 within a formation 501 is shown having three drilling operation devices 502, 504, 506. In this particular embodiment each of the drilling operation devices 502, 504, 506 is a disintegrating device. The drilling operation devices 502, 504, 506 are arranged at an end of the drill string 500. The drilling operation devices 502, 504, 506 are each arranged with a controller or part of a control system configured therein, for example, as shown and described above with respect to FIG. 3. Each of the controllers of each drilling operation device 502, 504, 506 is in communication with the other controllers or other components of the control system to form a closed loop system. Further, each drilling operation device 502, 504, 506 includes one or more sensors arranged to monitor one or more device characteristics (e.g., torque, weight-on-device, etc.). In this second example scenario, the first drilling operation device 502 is off-bottom (e.g., not drilling into the formation 501), the second drilling operation device 504 is activated, and the third drilling operation device 506 is deactivated.

Figure 6:
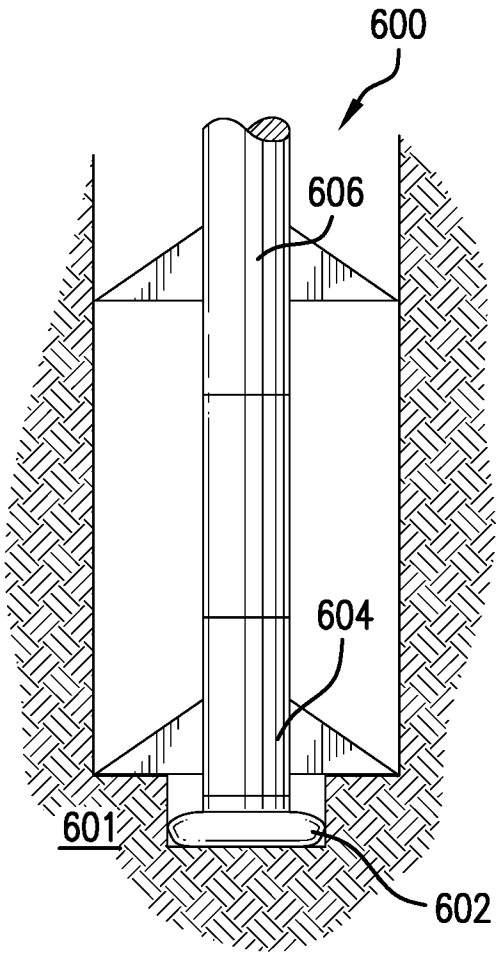
FIG. 6 is a schematic illustration of a third example scenario of operation of drilling string arranged in accordance with an embodiment of the present disclosure.

Turning now to FIG. 6, a third example scenario is shown. In FIG. 6, a drill string 600 within a formation 601 is shown having three drilling operation devices 602, 604, 606. In this particular embodiment each of the drilling operation devices 602, 604, 606 is a disintegrating device. The drilling operation devices 602, 604, 606 are arranged at an end of the drill string 600. The drilling operation devices 602, 604, 606 are each arranged with a controller configured therein, for example, as shown and described above with respect to FIG. 3. Each of the controllers of each drilling operation device 602, 604, 606 is in communication with the other controllers to form a closed loop system. Further, each drilling operation device 602, 604, 606 includes one or more sensors arranged to monitor one or more device characteristics (e.g., torque, weight-on-device, etc.). In this third example scenario, the first drilling operation device 602 is on-bottom (e.g., drilling into the formation 601), the second drilling operation device 604 is activated, and the third drilling operation device 606 is activated.

Figure 7:
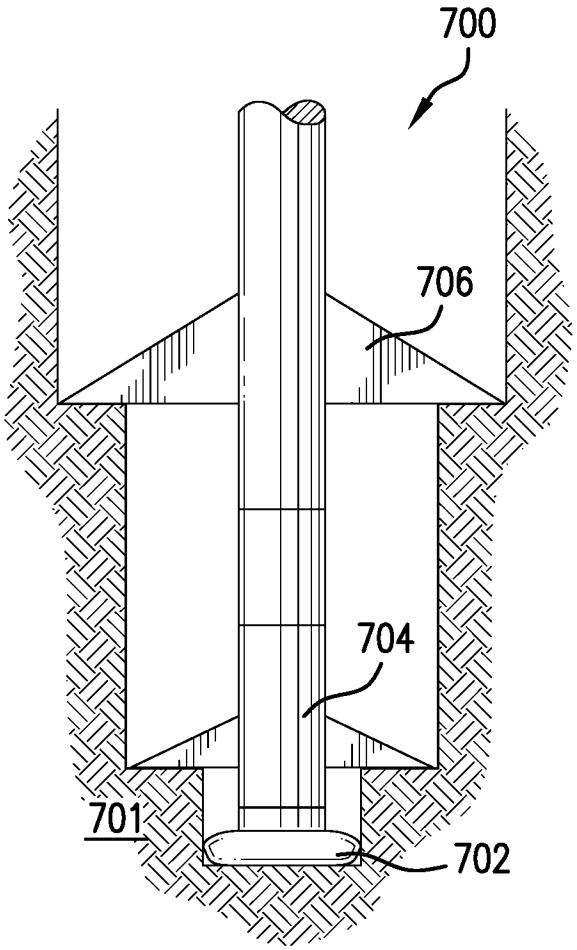
FIG. 7 is a schematic illustration of a fourth example scenario of operation of drilling string arranged in accordance with an embodiment of the present disclosure.

Turning now to FIG. 7, a fourth example scenario is shown. In FIG. 7, a drill string 700 within a formation 701 is shown having three drilling operation devices 702, 704, 706. In this particular embodiment each of the drilling operation devices 702, 704, 706 is a disintegrating device. The drilling operation devices 702, 704, 706 are arranged at an end of the drill string 700. The drilling operation devices 702, 704, 706 are each arranged with a controller configured therein, for example, as shown and described above with respect to FIG. 3. Each of the controllers of each drilling operation device 702, 704, 706 is in communication with the other controllers to form a closed loop system. Further, each drilling operation device 702, 704, 706 includes one or more sensors arranged to monitor one or more device characteristics (e.g., torque, weight-on-device, etc.). In this fourth example scenario, the first drilling operation device 702 is on-bottom (e.g., drilling into the formation 701), the second drilling operation device 704 is activated, and the third drilling operation device 706 is activated. Further, as illustratively shown, the second and third drilling operation devices 704, 706 have different hole opening sizes and/or diameters, to thus cut different dimension sections of borehole within the formation 701.

Figure 8:
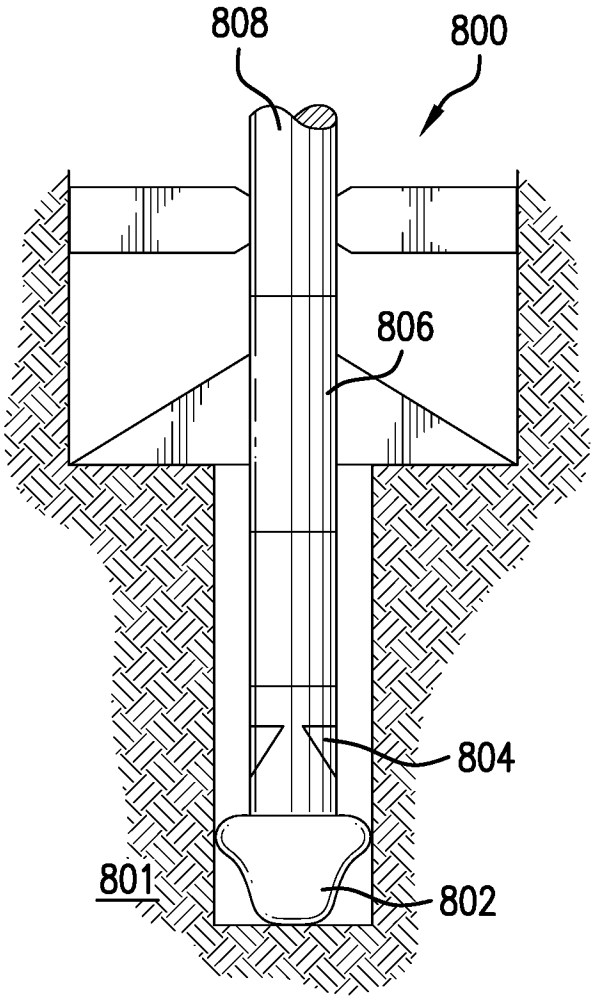
FIG. 8 is a schematic illustration of a fifth example scenario of operation of drilling string arranged in accordance with an embodiment of the present disclosure.

Turning now to FIG. 8, a fifth example scenario is shown. In FIG. 8, a drill string 800 within a formation 801 is shown having four drilling operation devices 802, 804, 806, 808. In this particular embodiment, the first three drilling operation devices 802, 804, 806 are disintegrating devices and the fourth drilling operation device 808 is a stabilizer. The drilling operation devices 802, 804, 806, 808 are arranged at an end of the drill string 800. The drilling operation devices 802, 804, 806, 808 are each arranged with a controller configured therein, for example, as shown and described above with respect to FIG. 3. In the case of the fourth drilling operation device 808, the moveable elements may be stabilizer elements (e.g., blades or pads) rather than cutters or cutting elements as described above. Each of the controllers of each drilling operation device 802, 804, 806, 808 is in communication with the other controllers to form a closed loop system. Further, each drilling operation device 802, 804, 806, 808 includes one or more sensors arranged to monitor one or more device characteristics (e.g., torque, weight-on-device, etc.). In this fifth example scenario, the first drilling operation device 802 is on-bottom (e.g., drilling into the formation 801), the second drilling operation device 804 is deactivated, the third drilling operation device 806 is activated, and the fourth drilling operation device 808 is activated (e.g., engaged with a borehole wall).

Various combinations of the above described scenarios and/or configurations may employ embodiments of the present disclosure. For example, any of the embodiments shown in FIGS. 4-7 can include stabilizers as shown in FIG. 8. In any of the above described embodiments, or variations thereon, drilling operation characteristics can be collected at one or more of the various drilling operation devices (e.g., using sensors on the respective drilling operation devices). The monitored data can be collected at respective controllers and communicated between the various controllers. Based on this information, each controller can make adjustments of adjustable elements of the respective drilling operation devices to adjust a cutting characteristic. As described above, the controllers can form at least part of a control system that incorporates various downhole controllers, control elements, control units, and/or surface control elements or components.

Figure 9:
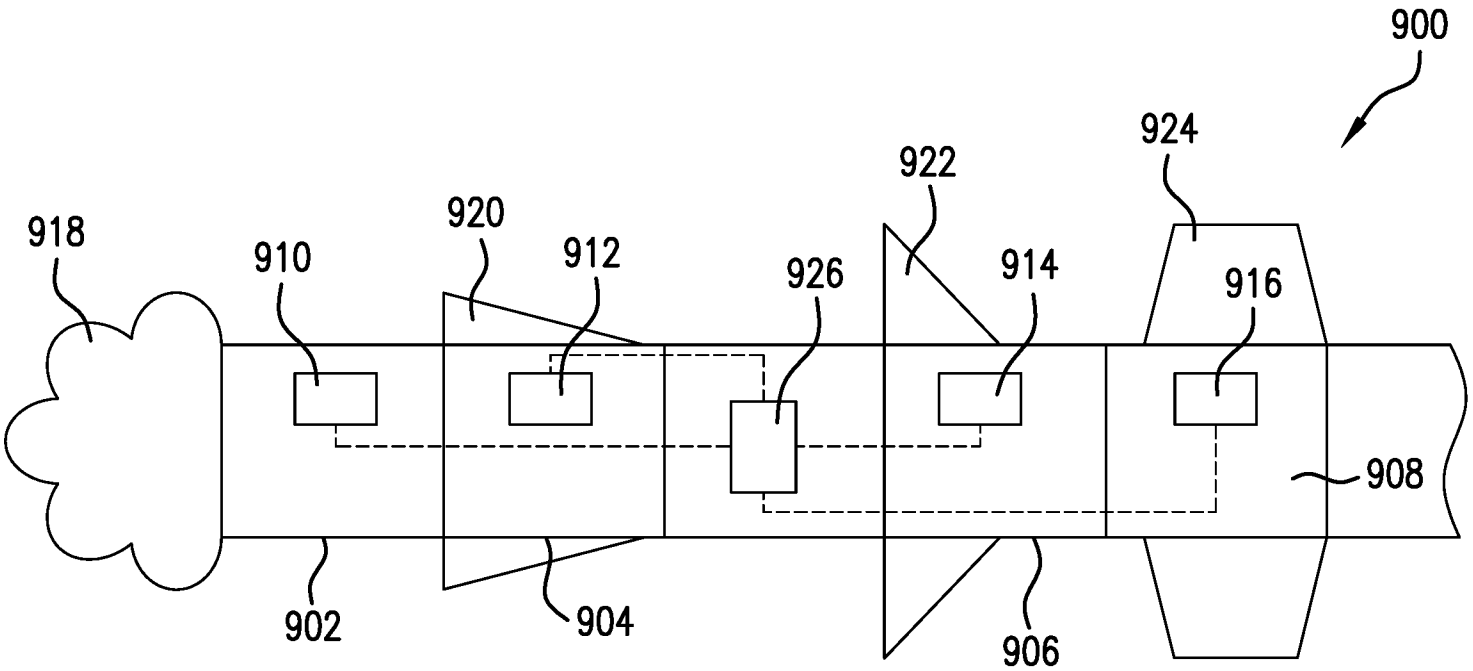
FIG. 9 is a schematic illustration of a drilling string having a plurality of drilling operation devices arranged in accordance with an embodiment of the present disclosure.

Turning now to FIG. 9, a drill string 900 having four drilling operation devices 902, 904, 906, 908. Similar to the embodiment shown in FIG. 8, the first three drilling operation devices 902, 904, 906 are disintegrating devices and the fourth drilling operation device 908 is a stabilizer. The drilling operation devices 902, 904, 906, 908 are arranged at an end of the drill string 900. The drilling operation devices 902, 904, 906, 908 are each arranged with a respective controller 910, 912, 914, 916. Further, each drilling operation device 902, 904, 906, 908 includes at least one adjustable element 918, 920, 922, 924, respectively. Because the first, second, and third drilling operation devices 902, 904, 906 are disintegrating devices, the adjustable elements 918, 920, 922 may be blades, cutters, or combinations thereof. The fourth drilling operation device 908 is arranged as a stabilizer and thus the adjustable elements 924 may be adjustable stabilizing blades or stabilizing pads, as known in the art. Each drilling operation device 902, 904, 906, 908 includes one or more sensors arranged to monitor one or more device characteristics (e.g., torque, weight-on-device, etc.).

In this embodiment, each of the controllers 910, 912, 914, 916 of the drilling operation devices 902, 904, 906, 908 is in communication with a system controller 926 and forms a closed loop system (e.g., forming a control system). The system controller 926 is arranged to receive data collected by each of the other controllers 910, 912, 914, 916 (e.g., collected from respective sensor(s)). The system controller 926 may then instruct each controller 910, 912, 914, 916 to control respective adjustable elements 918, 920, 922, 924 of the various drilling operation devices 902, 904, 906, 908 to achieve a desired operating efficiency of the drill string 900.

Figure 10:
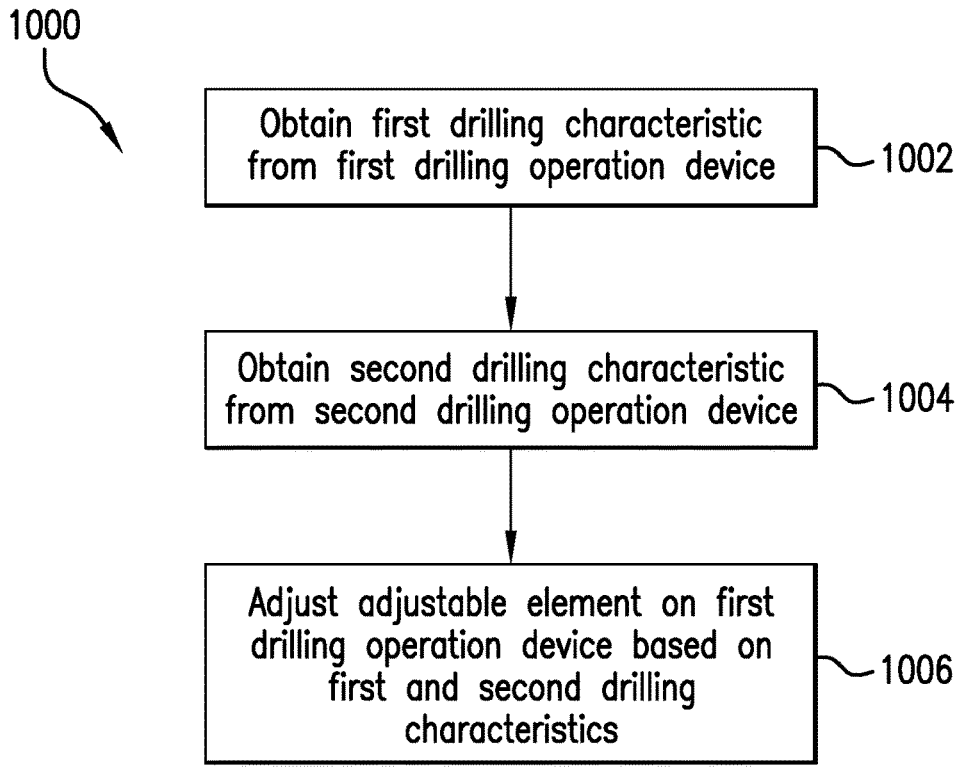
FIG. 10 is a flow process for automating adjustment of adjustable elements of drilling operation devices in accordance with an embodiment of the present disclosure.

Turning now to FIG. 10, a flow process 1000 for automatically controlling one or more drilling operation devices of a drill string is shown. The flow process 1000 can be performed using one or more controllers (or a system controller) as shown and described above, that is operably connected to and/or in communication with sensors for monitoring drilling characteristics (e.g., weight-on-device, torque, environmental conditions, etc.) and controllers and/or drive mechanisms for adjusting at least one adjustable element on the drilling operation devices. The flow process 1000 can be performed automatically during a drilling operation using a drill string having at least two drilling operation devices, e.g., as shown and described herein.

At block 1002, a control system (or part thereof) obtains a first drilling characteristic from a first drilling operation device. The first drilling characteristic can be a weight-on-device, a torque, an environmental condition, or other characteristic that is an aspect of the first drilling operation device operation, location, environment, etc. The first drilling characteristic can be obtained from one or more sensors located on, in, or associated with the first drilling operation device. The control system, in one example embodiment, can include a controller of the first drilling operation device or a system controller, as described above.

At block 1004, the control system obtains a second drilling characteristic from a second drilling operation device. The second drilling characteristic can be a weight-on-device, a torque, an environmental condition, or other characteristic that is an aspect of the second drilling operation device operation, location, environment, etc. The second drilling characteristic can be obtained from one or more sensors located on, in, or associated with the second drilling operation device. The control system can include a controller of the second drilling operation device, the first drilling operation device, or a system controller, as described above.

At block 1006, the control system causes at least one adjustable element of the first drilling operation device to be adjusted. For example, the control system may be in operable communication with a drive mechanism that acts upon the adjustable element to change a position of the adjustable element relative to a tool body (or part thereof). The adjustable element may be a cutting blade, cutter, cutting element, stabilizer blade, stabilizer pad, or other element that may engage with or otherwise interact with a formation and/or borehole during a drilling operation. The adjustment is prompted by and/or in reaction to at least one of the obtained drilling characteristics.

Figure 11:
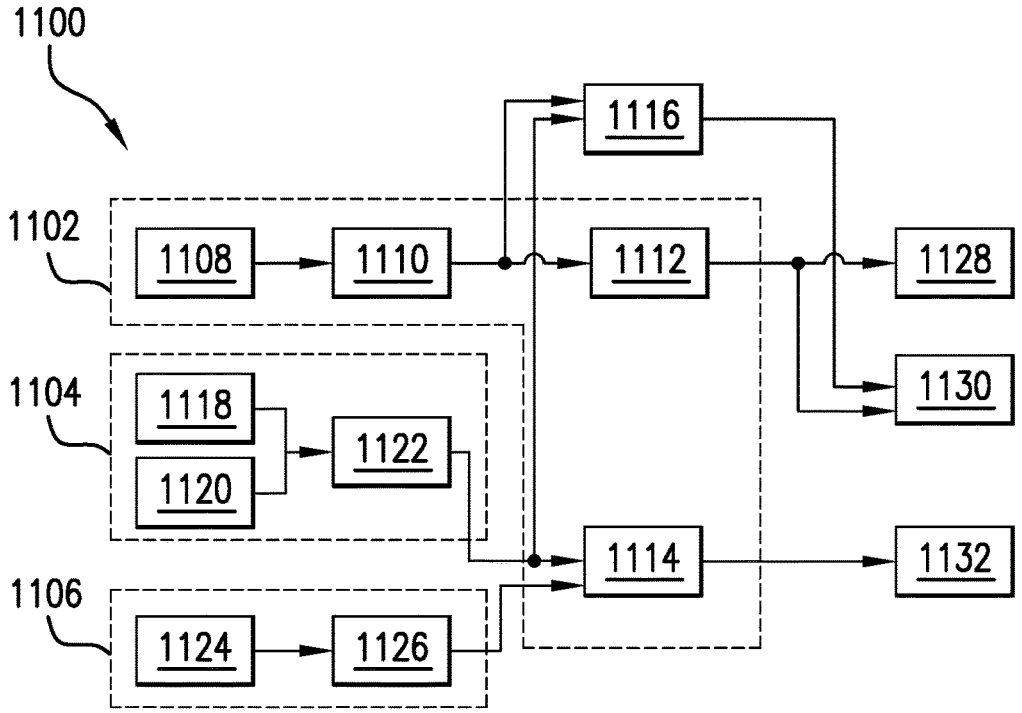
FIG. 11 is a schematic block diagram of a system illustrating various components in accordance with an embodiment of the present disclosure.

Turning now to FIG. 11, a block diagram of a system 1100 in accordance with an embodiment of the present disclosure is shown. The system 1100 is a schematic diagram illustrating various components of the systems shown and described above. For example, in FIG. 11, the system 1100 includes a first drilling operation device 1102, a second drilling operation device 1104, and a third drilling operation device 1106 that are each operably connected to each other and/or in communication with each other. The drilling operation devices 1102, 1104, 1106 are arranged along a drill string, as shown and described above. Although shown with a specific example number of drilling operation devices, those of skill in the art will appreciate that systems in accordance with the present disclosure can include any number of drilling operation devices can be arranged along a drill string and in operate within and/or as part of the system, without departing from the scope of the present disclosure.

The first drilling operation device 1102 includes a first sensor 1108, a first processor 1110, a first controller 1112, and a second controller 1114, with the first and second controllers 1112, 1114 forming all or part of a control system. The first sensor 1108 communicates with the first processor 1110 which can process a signal from the first sensor 1108 and communicate data to the first controller 1112. The first processor 1110 can also communicate data to an operator 1116 or a surface component. The second drilling operation device 1104 includes a second sensor 1118 and a third sensor 1120. The second and third sensors 1118, 1120 communicate to a second processor 1122, which can in turn communicate data to the second controller 1114 and/or the operator 1116. The third drilling operation device 1106 includes a fourth sensor 1124 that communicates with a third processor 1126, which in turn can communicate data to the second controller 1114. The controllers 1112, 1114 and/or the operator 1116 can output control signals to adjust one or more adjustable elements of the drilling operation devices 1102, 1104, 1106. For example, a first adjustable element 1128 of the first drilling operation device 1102, a second adjustable element 1130 of the second drilling operation device 1104, and/or a third adjustable element 1132 of the third drilling operation device 1106 can be instructed or controlled by the controllers 1112, 1114 and/or the operator 1116 to adjust one or more drilling characteristics.

In one non-limiting example, the first drilling operation device 1102 is a bit on a drill string, the second drilling operation device 1104 is a reamer, and the third drilling operation device 1106 is a stabilizer which can have any position along the drill string and/or within a bottomhole assembly. Each drilling operation device 1102, 1104, 1106 includes at least one adjustable element, such as blades, cutting elements, stabilizer elements, etc. which can be tilted, extended, retracted, rotated, etc.

The sensors 1108, 1118, 1120, 1124 are configured to measure one or multiple drilling characteristics, such as, but not limited to, torque, bending moment, vibrations (lateral, axial, torsional), stick-slip, whirl, shock, weight located within one or multiple of the drilling operations devices and/or located within any other part of the BHA (e.g. copilot, steering unit, etc.). The processors 1110, 1122, 1126 are connected to the sensors 1108, 1118, 1120, 1124 to obtain the drilling characteristics (e.g., typical signals, graphs, etc.) located near the respective sensors 1108, 1118, 1120, 1124. The controllers 1112, 1114 (which can be different from the sensors and/or processors, or the same electrical unit(s)) located anywhere in the BHA or on surface and can be either processor plus operational software (e.g., automated, closed-loop) or operator process (e.g., manual) that processes data from the sensor/processors (e.g., in real-time) to adjust drilling characteristics. For example, based on data from the sensors 1108, 1118, 1120, 1124 the processors and/or controllers can adjust one or more adjustable elements of the system 1100 (e.g., adjustable elements 1128, 1130, 1132) in order to change one or more drilling operations characteristics.

Embodiment 1

A method to adjust a drilling operation, the method comprising: obtaining, at a control system, a first drilling characteristic associated with a first drilling operation device that is part of a drilling system on a drill string; obtaining, at the control system, a second drilling characteristic associated with a second drilling operation device located apart from the first drilling operation device along the drill string;

and controlling, with the control system, at least one adjustable element of the first drilling operation device in response to at least one of the obtained first drilling characteristic and the second drilling characteristic, wherein adjustment of the at least one adjustable element causes a change in at least one of the first drilling characteristic and the second drilling characteristic.

Embodiment 2

The method according to any of the preceding embodiments, wherein the control system comprises at least one controller located downhole, the at least one controller configured to at least one of obtain the first drilling characteristic, obtain the second drilling characteristic, and adjust the at least one adjustable of the first drilling operation device.

Embodiment 3

The method according to any of the preceding embodiments, wherein the at least one controller is part of the first drilling operation device.

Embodiment 4

The method according to any of the preceding embodiments, wherein at least one of (i) the first drilling operation device is one of a drill bit, a reamer, or a stabilizer and (ii) the second drilling operation device is one of a drill bit, a reamer, or a stabilizer.

Embodiment 5

The method according to any of the preceding embodiments, wherein the at least one adjustable element is one of a cutter, a cutting element, a cutting blade, a stabilizing blade, or a stabilizing pad.

Embodiment 6

The method according to any of the preceding embodiments, wherein the drill string further includes a third drilling operation device located apart from the first drilling operation device and the second drilling operation device, the method further comprising: obtaining, at the control system, a third drilling characteristic associated with the third drilling operation device, wherein the adjustment of the at least one adjustable element is based on at least one of the obtained first drilling characteristic, the second drilling characteristic, and the third drilling characteristic.

Embodiment 7

The method according to any of the preceding embodiments, wherein the control system includes a first controller that part of the first drilling operation device and a second controller is part of the second drilling operation device, the method further comprising: controlling, with the first controller, at least one adjustable element of the first drilling operation device in response to at least one of the obtained first drilling characteristic and the second drilling characteristic, wherein adjustment of the at least one adjustable element of the first drilling operation device causes a change in at least one of the first drilling characteristic and the second drilling characteristic; and controlling, with the second controller, at least one adjustable element of the second drilling operation device in response to at least one of the obtained first drilling characteristic and the second drilling characteristic, wherein adjustment of the at least one adjustable element of the second drilling operation device causes a change in at least one of the first drilling characteristic and the second drilling characteristic.

Embodiment 8

The method according to any of the preceding embodiments, wherein the control system comprises at least one of a first control element associated with the first drilling operation device, a second control element associated with the second drilling operation device, and a surface control element.

Embodiment 9

The method according to any of the preceding embodiments, wherein the control system electrically controls adjustment of the at least one adjustable element.

Embodiment 10

The method according to any of the preceding embodiments, further comprising adjusting at least one adjustable element of each of the first and the second drilling operation devices.

Embodiment 11

A system to automatically adjust a drilling characteristic in a downhole operation, the system comprising: a drill string having: a first a drilling operation device having a first sensor and an adjustable element, the first sensor arranged to detect a first drilling characteristic associated with the first drilling operation device; and a second drilling operation device located apart from the first drilling operation device along the drill string and having a second sensor arranged to detect a second drilling characteristic associated with the second drilling operation device; and a control system located at least partially within the drill string and configured to: obtain, from the first sensor, the first drilling characteristic associated with a first drilling operation device; obtain, from the second sensor, the second drilling characteristic associated with a second drilling operation device; and control the adjustable element of the first drilling operation device in response to at least one of the obtained first drilling characteristic and the second drilling characteristic, wherein adjustment of the adjustable element causes a change in at least one of the first drilling characteristic and the second drilling characteristic.

Embodiment 12

The system according to any of the preceding embodiments, wherein the control system comprises at least one controller located downhole, the at least one controller configured to at least one of obtain the first drilling characteristic, obtain the second drilling characteristic, and adjust the at least one adjustable of the first drilling operation device.

Embodiment 13

The system according to any of the preceding embodiments, wherein at least one of (i) the first drilling operation device is one of a drill bit, a reamer, or a stabilizer and (ii) the second drilling operation device is one of a drill bit, a reamer, or a stabilizer.

Embodiment 14

The system according to any of the preceding embodiments, wherein the at least one adjustable element is one of a cutter, a cutting element, a cutting blade, a stabilizing blade, or a stabilizing pad.

Embodiment 15

The system according to any of the preceding embodiments, wherein the drill string further includes a third drilling operation device located apart from the first drilling operation device and the second drilling operation device, the controller further configured to: obtain, at the control system, a third drilling characteristic associated with the third drilling operation device, wherein the adjustment of the at least one adjustable element is based on at least one of the obtained first drilling characteristic, the second drilling characteristic, and the third drilling characteristic.

Embodiment 16

The system according to any of the preceding embodiments, wherein the controller is part of the first drilling operation device and a second controller is part of the second drilling operation device, wherein the second controller controls an adjustable element of the second drilling operation device in response to at least one of the obtained first drilling characteristic and the second drilling characteristic, wherein adjustment of the adjustable element of the second drilling operation device causes a change in the second drilling characteristic.

Embodiment 17

The system according to any of the preceding embodiments, wherein the control system comprises at least one of a first control element associated with the first drilling operation device, a second control element associated with the second drilling operation device, and a surface control element.

Embodiment 18

The system according to any of the preceding embodiments, wherein a drive mechanism is operably connected between a part of the control system and the adjustable element.

Embodiment 19

The system according to any of the preceding embodiments, wherein the adjustable element is adjustable with respect to an angle relative to the drill string or an extension relative to the drill string.

Embodiment 20

The system according to any of the preceding embodiments, further comprising a control unit located at a surface and arranged to communicate with the control system to perform the adjustment of the adjustable element.

In support of the teachings herein, various analysis components may be used including digital and/or analog systems. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The flow diagram(s) depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A method to adjust a drilling operation, the method comprising:

obtaining, at a control system, a first drilling characteristic associated with a first drilling operation device that is part of a drilling system on a drill string;

obtaining, at the control system, a second drilling characteristic associated with a second drilling operation device located apart from the first drilling operation device along the drill string; and controlling, with the control system, an adjustment of at least one adjustable element of the first drilling operation device in response to at least one of the obtained first drilling characteristic and the second drilling characteristic, wherein the adjustment of the at least one adjustable element of the first drilling operation device causes a change in at least one of the first drilling characteristic and the second drilling characteristic, wherein the control system includes a first controller that is part of the first drilling operation device and a second controller that is part of the second drilling operation device, the method further comprising:

controlling, with the first controller, the adjustment of the at least one adjustable element of the first drilling operation device in response to at least one of the obtained first drilling characteristic and the second drilling characteristic, wherein the adjustment of the at least one adjustable element of the first drilling operation device causes a change in at least one of the first drilling characteristic and the second drilling characteristic; and controlling, with the second controller, an adjustment of at least one adjustable element of the second drilling operation device in response to at least one of the obtained first drilling characteristic and the second drilling characteristic, wherein the adjustment of the at least one adjustable element of the second drilling operation device causes a change in at least one of the first drilling characteristic and the second drilling characteristic.

2. The method of claim 1, wherein:

(i) the first drilling operation device is one of a drill bit or a reamer and (ii) the second drilling operation device is one of a drill bit or a reamer, and the at least one adjustable element of one the first drilling operation device and the second drilling operation device is included in one of a disintegrating device blade of the drill bit and a disintegrating device blade of the reamer, with the at least one adjustable element of one of the first drilling operation device and the second drilling operation device being adjustable relative to the respective disintegrating device blade.

3. The method of claim 1, wherein the first controller is configured to obtain the first drilling characteristic, and the second controller is configured to obtain the second drilling characteristic.

4. The method of claim 1, wherein the at least one adjustable element of one of the first drilling operation device and the second drilling operation device is adjustable in at least one of an angle of tilt, an axial extension, and a rotation about an axis of the at least one adjustable element of one of the first drilling operation device and the second drilling operation device.

5. The method of claim 1, wherein the drill string further includes a third drilling operation device located apart from the first drilling operation device and the second drilling operation device, the method further comprising:

obtaining, at the control system, a third drilling characteristic associated with the third drilling operation device, wherein the adjustment of the at least one adjustable element of one of the first drilling operation device and the second drilling operation device is based on at least one of the obtained first drilling characteristic, the second drilling characteristic, and the third drilling characteristic.

6. The method of claim 1, wherein the control system comprises at least one of a first control element associated with the first drilling operation device and a second control element associated with the second drilling operation device.

7. The method of claim 1, wherein the control system is configured to electrically control the adjustment of the at least one adjustable element of one of the first drilling operation device and the second drilling operation device.

8. The method of claim 1, wherein the at least one adjustable element of one of the first drilling operation device and the second drilling operation device is a disintegrating device blade.

9. The method of claim 1, wherein the adjustable element of at least one of the first drilling operation device and the second drilling operation device is an adjustable element.

10. A system to automatically adjust a drilling characteristic in a downhole operation, the system comprising:

a drill string having:

a first drilling operation device having a first sensor and an adjustable element, the first sensor configured to detect a first drilling characteristic associated with the first drilling operation device; and a second drilling operation device located apart from the first drilling operation device along the drill string and having a second sensor configured to detect a second drilling characteristic associated with the second drilling operation device; and a control system located at least partially within the drill string and configured to:

obtain, from the first sensor, the first drilling characteristic associated with the first drilling operation device;

obtain, from the second sensor, the second drilling characteristic associated with the second drilling operation device; and control an adjustment of the adjustable element of the first drilling operation device in response to at least one of the obtained first drilling characteristic and the second drilling characteristic, wherein the adjustment of the adjustable element of the first drilling operation device causes a change in at least one of the first drilling characteristic and the second drilling characteristic, wherein the control system comprises a first controller that is part of the first drilling operation device and a second controller that is part of the second drilling operation device, wherein the second controller is configured to control an adjustment of an adjustable element of the second drilling operation device in response to at least one of the obtained first drilling characteristic and the second drilling characteristic, wherein the adjustment of the adjustable element of the second drilling operation device causes a change in at least one of the first drilling characteristic and the second drilling characteristic.

11. The system of claim 10, wherein:

(i) the first drilling operation device is one of a drill bit or a reamer and (ii) the second drilling operation device is one of a drill bit or a reamer, and the adjustable element of one of the first drilling operation device and the second drilling operation device is included in one of a disintegrating device blade of the drill bit and a disintegrating device blade of the reamer, with the at least one adjustable element of one of the first drilling operation device and the second drilling operation device being adjustable relative to the respective disintegrating device blade.

12. The system of claim 10, wherein the first controller is configured to obtain the first drilling characteristic, and the second controller is configured to obtain the second drilling characteristic.

13. The system of claim 10, wherein the adjustable element of one of the first drilling operation device and the second drilling operation device is adjustable in at least one of an angle of tilt, an axial extension, and a rotation about an axis of the at least one adjustable element of one of the first drilling operation device and the second drilling operation device.

14. The system of claim 10, wherein the drill string further includes a third drilling operation device located apart from the first drilling operation device and the second drilling operation device, the control system further configured to:

obtain, at the control system, a third drilling characteristic associated with the third drilling operation device, wherein the adjustment of the adjustable element of one of the first drilling operation device and the second drilling operation device is based on at least one of the obtained first drilling characteristic, the second drilling characteristic, and the third drilling characteristic.

15. The system of claim 10, wherein the control system comprises at least one of a first control element associated with the first drilling operation device and a second control element associated with the second drilling operation device.

16. The system of claim 10, wherein a drive mechanism is operably connected between a part of the control system and the adjustable element of one of the first drilling operation device and the second drilling operation device.

17. The system of claim 16, wherein the drive mechanism is one of a motor, an electrical drive unit, and a pressure arrangement configured to provide fluid pressure control.

18. The system of claim 10, wherein the adjustable element of one of the first drilling operation device and the second drilling operation device is adjustable with respect to an angle relative to the drill string or an extension relative to the drill string.

19. The system of claim 10, further comprising a control unit located at a surface and configured to communicate with the control system to perform the adjustment of the adjustable element of one of the first drilling operation device and the second drilling operation device.

20. The system of claim 10, wherein the adjustable element of at least one of the first drilling operation device and the second drilling operation device is an adjustable element.

* * * * *